US007383810B1

(12) United States Patent
Emley

(10) Patent No.: US 7,383,810 B1
(45) Date of Patent: Jun. 10, 2008

(54) AIR INDUCTION SYSTEM HAVING AN INTEGRATED RESONATOR

(75) Inventor: John Emley, Livonia, MI (US)

(73) Assignee: Automotive Components Holdings, LLC, Dearborn, MI (US)

( * ) Notice: Subject to any disclaimer, the term of this patent is extended or adjusted under 35 U.S.C. 154(b) by 0 days.

(21) Appl. No.: 11/709,589

(22) Filed: Feb. 22, 2007

(51) Int. Cl.
*F02B 77/04* (2006.01)
*F02M 35/10* (2006.01)

(52) U.S. Cl. ..... 123/198 E; 123/184.57; 181/229

(58) Field of Classification Search ..... 123/198 E, 123/184.57; 181/229
See application file for complete search history.

(56) References Cited

U.S. PATENT DOCUMENTS 5,059,221 A * 10/1991 McWilliam ..... 123/198 E
5,560,330 A 10/1996 Andress et al.
5,572,966 A 11/1996 Doddy et al.
6,167,862 B1 * 1/2001 Powell et al. ..... 123/198 E

* cited by examiner

*Primary Examiner*—Noah Kamen
(74) *Attorney, Agent, or Firm*—MacMillan Sobanski & Todd, LLC.

(57) ABSTRACT

An air induction system for carrying air to the intake of an internal combustion engine includes an air cleaner housing including a surface at least partially enclosing a first chamber or cover located in the air cleaner housing, an inlet through which air enters the air cleaner, and a MAFS bore through which air exits the air cleaner and passes to the engine intake, a second housing secured to the outer surface, the second housing and outer surface enclosing a second chamber, the second housing including a first port which comprise a sound attenuation device or devices.

11 Claims, 2 Drawing Sheets

AIR INDUCTION SYSTEM HAVING AN INTEGRATED RESONATOR

BACKGROUND OF THE INVENTION

1. Field of the Invention

This invention relates generally to an apparatus for inducting air into an engine and, in particular, to such apparatus in which a resonator is located.

2. Description of the Prior Art

Air inducted into the intake manifold of an internal combustion engine is tuned to minimize the effects of standing waves and other acoustic phenomena generated in the air induction system, the intake manifold, and the engine.

For this purpose, the inducted air flows through an expansion chamber (commonly called the air cleaner) and from there into the engine. The expansion chamber prevents the formation of large amplitude standing waves and dissipates the sound energy in the system. However, the use of resonators may permit a characteristic decline in sound pressure level generated by the engine at certain particular narrow ranges of engine speeds, since expansion chamber resonators typically are not effective at all noise frequencies.

A Helmholtz resonator includes a chamber, which does not receive the induction air flow but instead communicates with the air flow path through a passageway. Conventionally, a Helmholtz resonator is mounted at a right angle with respect to ducts that carry air to the engine. Sometimes limited package space in the engine compartment necessitates a very short clean-air tube and a short inlet tube to conserve space, leaving insufficient space for a side-mounted Helmholtz resonator.

Frequently a mass air flow sensor (MAFS), used to control engine operation, is located in the air induction system. The MAFS presents unique placement and package space requirements.

There is a need in the industry for an air induction system in which the neck for the resonator is manufactured integrally and parallel to the MAFS bore.

SUMMARY OF THE INVENTION

The Air Induction System (AIS) includes a neck for a Helmholtz resonator which is manufactured integrally and parallel to a bore containing the MAFS. The air induction system saves package space by integrating the body of the resonator with the cover of the AIS housing. The neck of the resonator is parallel to the MAFS bore and integrated into it, thereby further minimizing the size of the AIS.

The resonator can either be welded onto the housing or molded as one piece with the rest of the housing. The resonator may be a single chamber resonator or a multiple chamber resonator by dividing the neck and the body of the resonator into two or more chambers.

The air cleaner typically consists of two parts: a dirty side, hereafter referred to as the tray, and a clean side, hereafter referred to as the cover. The filter element separates the two parts. The air cleaner cover has a port that connects to the clean-air tube. Modern air cleaners incorporate a Mass Air Flow Sensor (MAFS) mount molded integrally as part of this port. Hereafter this port on the cover connecting to the clean-air tube is referred to as the MAFS bore. The resonator is welded or otherwise securely attached to the cover of the air cleaner. The neck of the resonator is parallel to the MAFS bore and communicates with the clean-air tube.

An AIS for carrying air to the intake of an internal combustion engine includes an air cleaner housing enclosing the filter element, an inlet through which air enters the air cleaner, and an outlet tube through which air exits the air cleaner and passes into the engine intake.

The scope of applicability of the preferred embodiment will become apparent from the following detailed description, claims and drawings. It should be understood, that the description and specific examples, although indicating preferred embodiments of the invention, are given by way of illustration only. Various changes and modifications to the described embodiments and examples will become apparent to those skilled in the art.

DESCRIPTION OF THE DRAWINGS

The invention will be more readily understood by reference to the following description, taken with the accompanying drawings, in which.

DESCRIPTION OF THE PREFERRED EMBODIMENT

Figure 1:
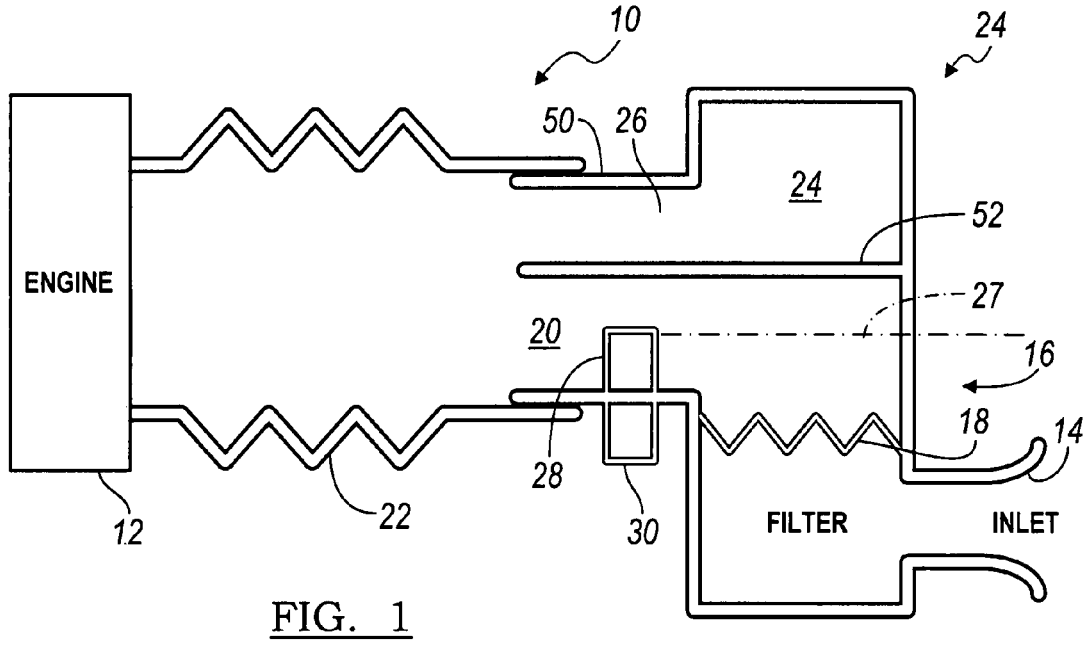
FIG. 1 is a schematic diagram of an air induction cover and resonator.

Referring first to FIG. 1, an air induction system 10 for supplying air to the intake manifold of an internal combustion engine 12 includes an inlet 14 attached to an air cleaner 16 which contains a particulate filter element 18, through which the air passes into the MAFS bore 20 and then through a clean-air tube 22 to the engine 12. A resonator housing 24 includes a port 26, which is parallel to a longitudinal axis 27 of the MAFS bore 20 and communicates pneumatically with passage 20, the clean air tube 22 and the engine intake 12. A mass air flow sensor (MAFS) 28 extends into MAFS bore 20 through the walls of the first housing 16 and includes an external portion 30, located outside passage 20. The MAFS 28 produces a signal representing the mass flow rate of air through the MAFS bore 20.

Figure 2:
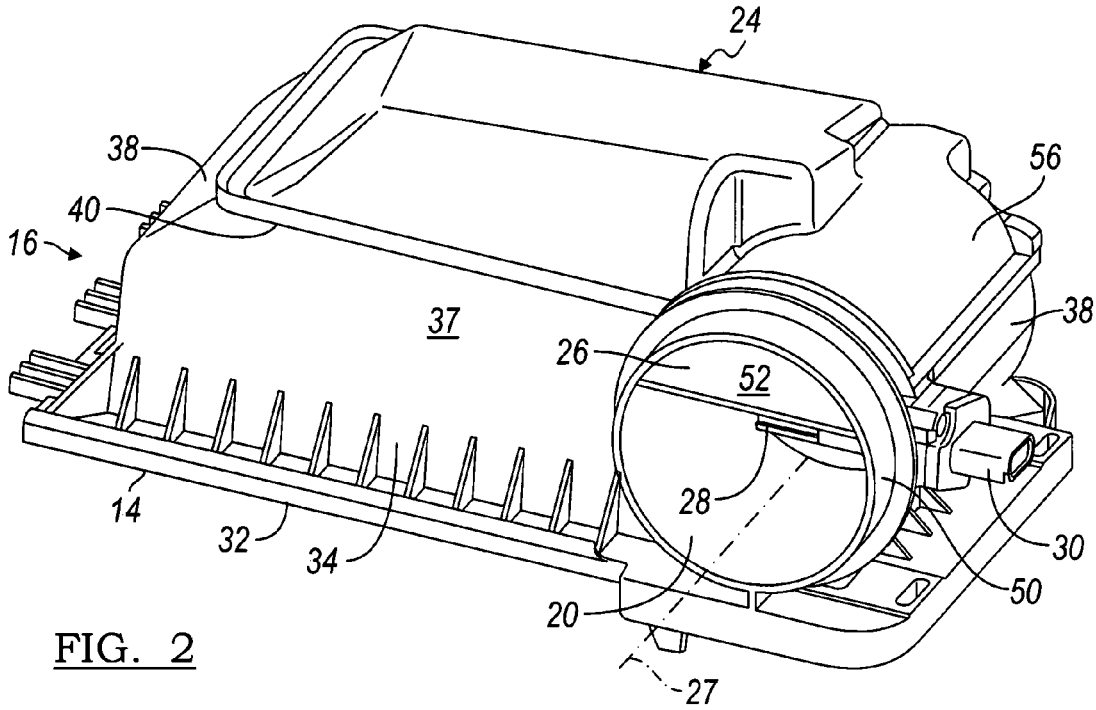
FIG. 2 is an isometric view from above showing the cover assembly in its assembled condition.
Figure 3:
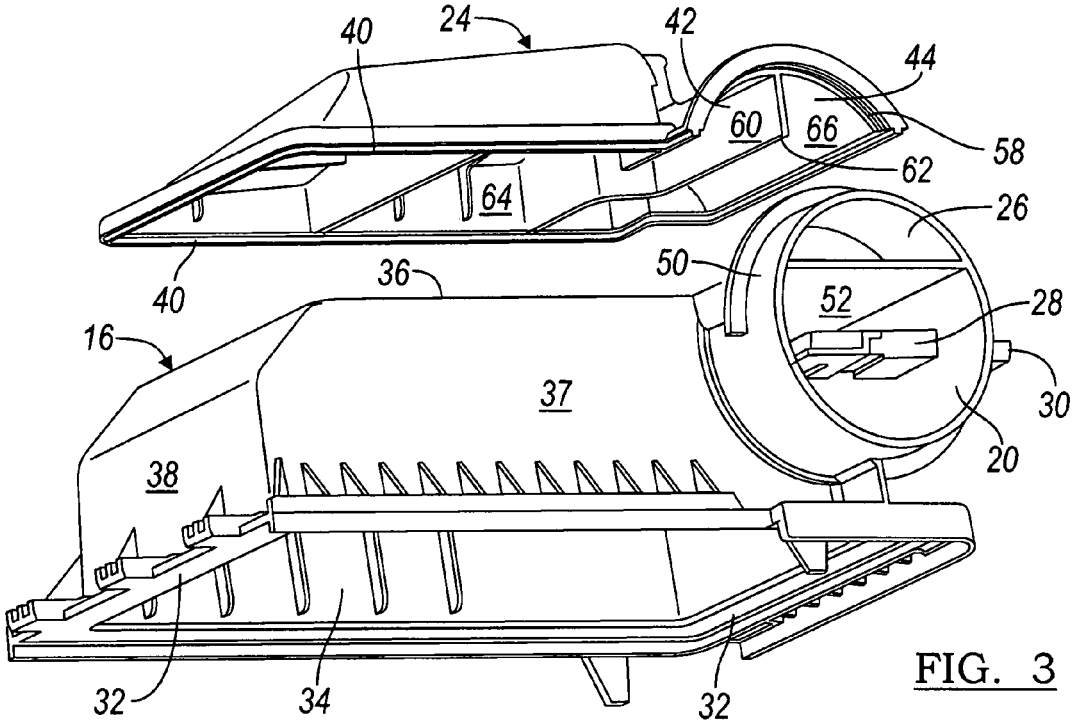
FIG. 3 is an isometric view of the system showing the underside of the resonator and housing in spaced-apart relation.
Figure 4:
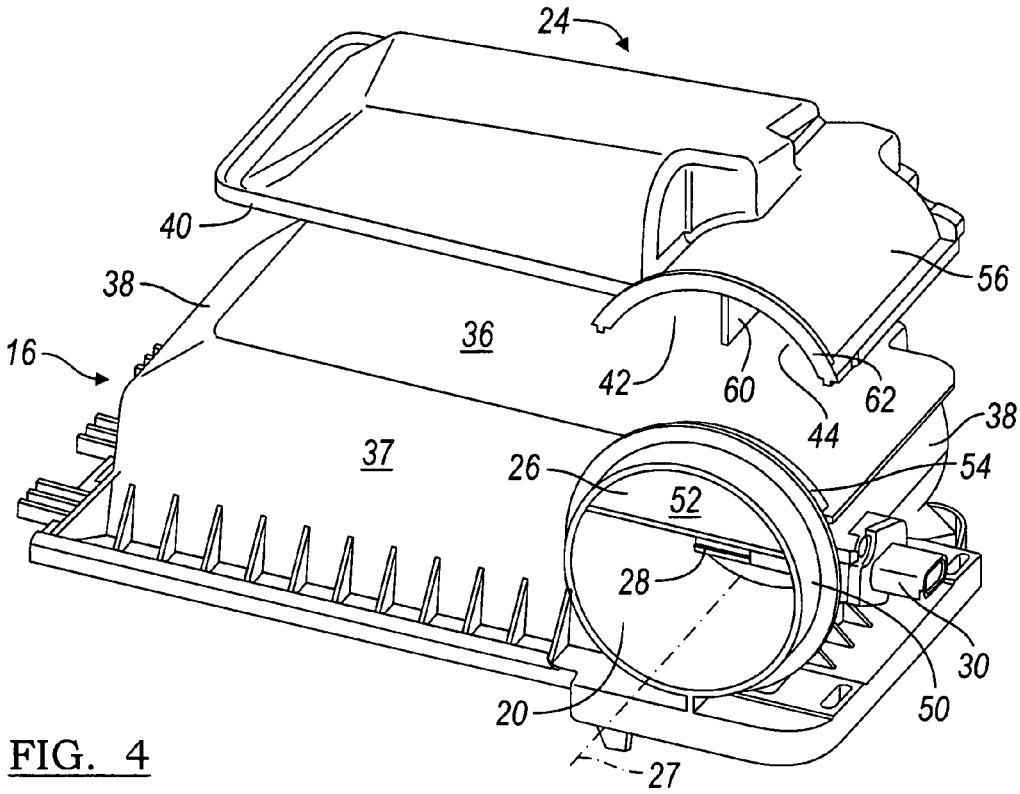
FIG. 4 is an isometric view from above showing the cover and resonator before they are assembled.

Referring now to FIGS. 2-4, the cover 16 is formed with a longitudinal mounting flange 32, which extends along the periphery of the cavity 34 at the underside of the cover, through which filtered air enters the cover 16 after passing through filter 18, which is located in the tray (not shown) located below the cover 16. Mounting flange 32 is sealed by the filter element's seal against the passage of air. The cover 16 is defined by a substantially hollow first chamber enclosed by an upper surface 36, lateral side walls 37 and end walls 38.

The air induction assembly 10 includes a second housing 24, the resonator housing, which is seated on and secured to the upper surface 36 of the cover 16 at a weld line 40, which extends along the peripheral base of the resonator housing 24, thereby sealing and enclosing the volume enclosed by housing 24 and the upper surface 36 of the cover 16. When the resonator housing 38 is welded or bonded to the cover 16 during assembly of the air induction system 10, the volume within resonator housing 24 is enclosed except for a first port 42 and a second port 44, which communicate the interior volume of resonator housing 24 to the clean-air tube 22.

The cover housing 16 is formed with a cylindrical neck 50, which extends laterally and is separated into two portions by a horizontal partition 52. The MAFS bore 20 is located below partition 52 and communicates with the interior of the cover housing 16. Resonator housing 24 is formed with partial cylindrical duct 56, and a vertical partition 60, which extends laterally and separates duct 56 into ports 42, 44 that communicate with the interior of the resonator housing 24. Upon assembly, housings 16 and 24 are mutually secured also at abutting surfaces of 40 and 36 and also at surfaces 54 and 58 to form an integral assembly of housings 16 and 24 comprising a unitary part having a leak-proof connection to join the housings.

As FIG. 3 illustrates, partition 60 includes a lower surface 62, which seats on and is welded to the upper surface 36 of housing 16, thereby dividing the interior of housing 24 into a second chamber 64 located on the left-hand side of partition 60, and a third chamber 66 located on the right-hand side of partition 60. Port 42 communicates with chamber 64; port 44 communicates with chamber 66. Ports 42 and 44 terminate at port 26, which communicates with outlet passage 20 at the lateral end of partition 52. Chamber 64 contains a resonator volume; chamber 66 contains a quarter-wave tuner volume.

In operation, air exiting filter 18 flows vertically upward into the cover housing 16, exits through the outlet passage 20 and enters the air intake of the engine 12. A flexible, clean air tube 22 engaged with and fastened to the neck 50, connects the air induction system 10 to the engine 12. Both the resonator chamber 64 port 42 and the quarter wave tuner chamber 66 port 44 extend parallel to the MAFS bore 20, which contains the mass air flow sensor portion 28. The external portion of the mass air flow sensor 30 is located at the outer surface of the MAFS bore 20 and extends through the wall thickness of the neck 50.

In accordance with the provisions of the patent statutes, the preferred embodiment has been described. However, it should be noted that the alternate embodiments can be practiced otherwise than as specifically illustrated and described.

What is claimed is:

1. An air induction system for carrying air to the intake of an internal combustion engine, comprising:

a first housing including a surface at least partially enclosing a first chamber located in the first housing, an inlet through which air enters the first chamber, an outlet passage through which air exits the first chamber and passes to the engine intake, and a first partition that separates the outlet passage and a first port;

a second housing secured to the surface and enclosing a second chamber, the second housing including the first port through which the second chamber communicates with the outlet passage, and a second partition that contacts the first partition and provides a boundary of the second chamber, the first partition and second partition at least partially providing a boundary of the first port; and a mass air flow sensor located in the outlet passage.

2. The air induction system of claim 1 wherein the second chamber and outlet passage comprise at least a portion of a Helmholtz resonator.

3. The air induction system of claim 1 wherein:

the second housing further encloses a third chamber; and the second housing further includes a second port through which the third chamber communicates with the outlet passage, and the second partition separates the second chamber from the third chamber, the first partition and second partition at least partially providing a boundary of the second port.

4. The air induction system of claim 1 wherein the second chamber comprises at least a portion of a quarter wave tuner.

5. The air induction system of claim 1 wherein:

the mass air flow sensor extends through a wall surrounding the outlet passage, the sensor including a first portion located in the outlet passage and a second portion located external to the outlet passage.

6. The air induction system of claim 1 wherein the second housing is secured to the surface by one of welding, a gasket and fasteners, and a leak-proof seal.

7. An air induction system for carrying air to the intake of an internal combustion engine, comprising:

a first housing including an upper surface at least partially enclosing a first chamber located in the first housing, an inlet through which air enters the first chamber, a neck directed laterally from the first chamber and including an outlet passage, through which air exits the first chamber and passes to the engine intake, and a first partition that separates the outlet passage and a first port;

a second housing secured to the upper surface and enclosing a second chamber, the second housing including a first port through which the second chamber communicates with the outlet passage, a second partition that contacts the first partition and provides a boundary of the second chamber, the first partition and second partition at least partially providing a boundary of the first port; and a mass air flow sensor extending through a wall of the neck and including a first portion located in the outlet passage and a second portion located external to the outlet passage.

8. The air induction system of claim 7 wherein the second chamber and outlet passage comprise at least a portion of a Helmholtz resonator.

9. The air induction system of claim 7 wherein:

the second housing and the outer surface further enclose a third chamber; and the second housing further includes a second port through which the third chamber communicates with the outlet passage, and the second partition separates the second chamber from the third chamber, the first partition and second partition at least partially providing a boundary of the second port.

10. The air induction system of claim 7 wherein the second chamber comprises at least a portion of a quarter wave tuner.

11. The air induction system of claim 7 wherein the neck is cylindrical having a longitudinal axis, and the outlet pass age is substantially parallel to the axis.

* * * * *